US009557761B2

(12) United States Patent
Sönmez

(10) Patent No.: US 9,557,761 B2
(45) Date of Patent: Jan. 31, 2017

(54) ROTARY/PUSH BUTTON CONTROLLER

(71) Applicant: Metin Sönmez, Erkelenz (DE)

(72) Inventor: Metin Sönmez, Erkelenz (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 24 days.

(21) Appl. No.: 14/627,931

(22) Filed: Feb. 20, 2015

(65) Prior Publication Data

US 2015/0241903 A1 Aug. 27, 2015

(30) Foreign Application Priority Data

Feb. 21, 2014 (DE) ..... 10 2014 102 227

(51) Int. Cl.
*H01H 13/62* (2006.01)
*G05G 1/02* (2006.01)
*G05G 1/10* (2006.01)

(52) U.S. Cl.
CPC ..... *G05G 1/025* (2013.01); *G05G 1/10* (2013.01); *Y10T 74/20468* (2015.01)

(58) Field of Classification Search
CPC ..... G05G 1/025; G05G 1/10; H01H 3/20; H01H 19/11; H01H 19/36; H01H 19/56; H01H 2239/024; H01H 2219/0622
USPC ..... 200/564, 565, 336, 11 R, 17 R, 341–342
See application file for complete search history.

(56) References Cited

U.S. PATENT DOCUMENTS

| | | | | |
|---|---|---|---|---|
| 6,642,824 | B2 | 11/2003 | Oomkes | |
| 7,705,261 | B1 | 4/2010 | Chen et al. | |
| 8,076,603 | B2 * | 12/2011 | Huang | H01H 3/20 200/336 |
| 2004/0007450 | A1 * | 1/2004 | Kojima | G05G 1/10 200/564 |
| 2006/0096845 | A1 * | 5/2006 | Zegula | B60K 37/06 200/341 |
| 2012/0055763 | A1 | 3/2012 | Chou | |
| 2012/0249315 | A1 | 10/2012 | Vanhelle et al. | |
| 2013/0276572 | A1 * | 10/2013 | Vogt | G05G 1/02 74/553 |

FOREIGN PATENT DOCUMENTS

| | | | |
|---|---|---|---|
| CN | 202282289 | U | 6/2012 |
| DE | 102012017123 | A1 | 2/2012 |
| DE | 102011083524 | A1 | 3/2013 |
| DE | 102012005474 | A1 | 9/2013 |
| EP | 2490240 | A1 | 8/2012 |

(Continued)

*Primary Examiner* — Kyung Lee
(74) *Attorney, Agent, or Firm* — Dickinson Wright PLLC

(57) ABSTRACT

A rotary/push button controller is provided herein. The controller includes an outer ring being movable, radially at a rotation angle about a rotation axis, and axially along the rotation axis, the outer rings being integrally formed with a centrally disposed shaft, the shaft includes a connection to an electric switch in response to the axial movement of the shaft; an intermediate space between an inner wall of the outer ring and the shaft; an inner ring being disposed in the intermediate space between the inner wall of the outer ring and the shaft coaxially in relation to the shaft and to the outer ring; and a roller bearing having at least two rows of roller bodies, which are situated between the inner wall of the outer ring and the outer wall of the inner ring.

7 Claims, 2 Drawing Sheets

(56) References Cited

FOREIGN PATENT DOCUMENTS

| | | | |
|---|---|---|---|
| EP | 2639806 | A1 | 9/2013 |
| FR | 2986658 | A1 | 8/2013 |
| GB | 1196747 | A | 7/1970 |
| WO | 2012/093005 | A1 | 7/2012 |
| WO | 2013/113581 | A1 | 8/2013 |

* cited by examiner

ROTARY/PUSH BUTTON CONTROLLER

CROSS-REFERENCE TO RELATED APPLICATIONS

This U.S. patent application claims priority to German Patent Application No. 10 2014 102 227.0, filed Feb. 21, 2014 entitled "ROTARY/PUSH BUTTON CONTROLLER," the entire disclosure of the application being considered part of the disclosure of this application and hereby incorporated by reference.

BACKGROUND

Rotary/push buttons have a slide bearing and centrally disposed push button activation or a ball bearing having a non-centrally placed push button activation with or without additional gearings.

Since slide bearings require clearance between the guide surfaces, this solution generally causes a wobbling of the rotary button. In the second solution with the ball bearing, the activation of the push button is not centrally placed, which generates a higher frictional torque. For effective feedback and tactile response, minimal friction and a minimal, wobbling of the rotary button, are removed. However, both properties (minimal friction and a minimal wobbling) work in opposition to one another. These two properties are described below:

- minimal guide clearance=>minimal wobbling of the rotary button, high friction
- large guide clearance=>minimal friction, greater wobbling of the rotary button.

A compromise between these two properties may be pursued. However, the smaller the diameter of the rotary-push button controller and of the resulting installation space, may make it more difficult to minimize the wobbling of the rotary button.

A switch device has a coaxial assembly along the longitudinal axis of a cylindrical core, which extends axially from a core base to a distal end. The core base is fixed to a base plate. An outer knob extends from the knob base to a distal knob top, the knob being rotatable along the longitudinal axis about the cylindrical core. A switching generates an electrical signal dependent on the rotations of the knob. A guiding of the knob in its movement relative to the cylindrical core is also provided. This knob guiding includes an upper-guide in the vicinity of the distal end of the cylindrical core and of the knob-top, as well as a lower-guide in the vicinity of the core base and the knob base. In this configuration, the upper-guide, in turn, includes rolling elements, these rolling elements roll between an inner race of the upper-guide, which is an integral component of the core, and an outer race of the upper-guide, which is an integral component of the knob. With the upper ball bearing arrangement thus provided, friction that occurs as a result of the rotational movement of the knob is prevented.

A rotary control/push-control device for a human-machine interface, in particular, for a vehicle component, such as an air conditioner is known. This rotary control/push-control device includes a rotary/push element, which is rotatable about a guide shaft and axially movable along the guide axis. The rotary/push-control device also includes a roller bearing unit having an outer bearing ring, an inner bearing ring and rollers disposed between outer bearing ring and inner bearing ring. In this configuration, the outer bearing ring—or alternatively, the inner bearing ring—is connected to the rotary/push element and is simultaneously rotatable by the latter. A rotation sensor detects the rotational movement of the rotary/push element. The rotary control/push control device also includes at least one of the two following groups of features, namely, a pressure sensor that responds to an axial movement of the rotary control/push control device along the guide shaft from a starting position to a depressed position, and a return element for automatically moving the rotary/push element to its starting position. The return element in this case acts directly or indirectly on the roller bearing unit. The inner bearing ring—or alternatively, the outer bearing ring—is guided on the guide axis in an axially movable manner and secured on said axis to prevent the bearing ring from rotating.

SUMMARY

A rotary/push button controller is provided herein. The controller includes an outer ring being movable, radially at a rotation angle about a rotation axis, and axially along the rotation axis, the outer rings being integrally formed with a centrally disposed shaft, the shaft includes a connection to an electric switch in response to the axial movement of the shaft; an intermediate space between an inner wall of the outer ring and the shaft; an inner ring being disposed in the intermediate space between the inner wall of the outer ring and the shaft coaxially in relation to the shaft and to the outer ring; and a roller bearing having at least two rows of roller bodies, which are situated between the inner wall of the outer ring and the outer wall of the inner ring.

DESCRIPTION OF THE DRAWINGS

Further details, features and advantages of the invention will become apparent from the following description of exemplary embodiments with reference to the associated drawings, in which.

Figure 1:
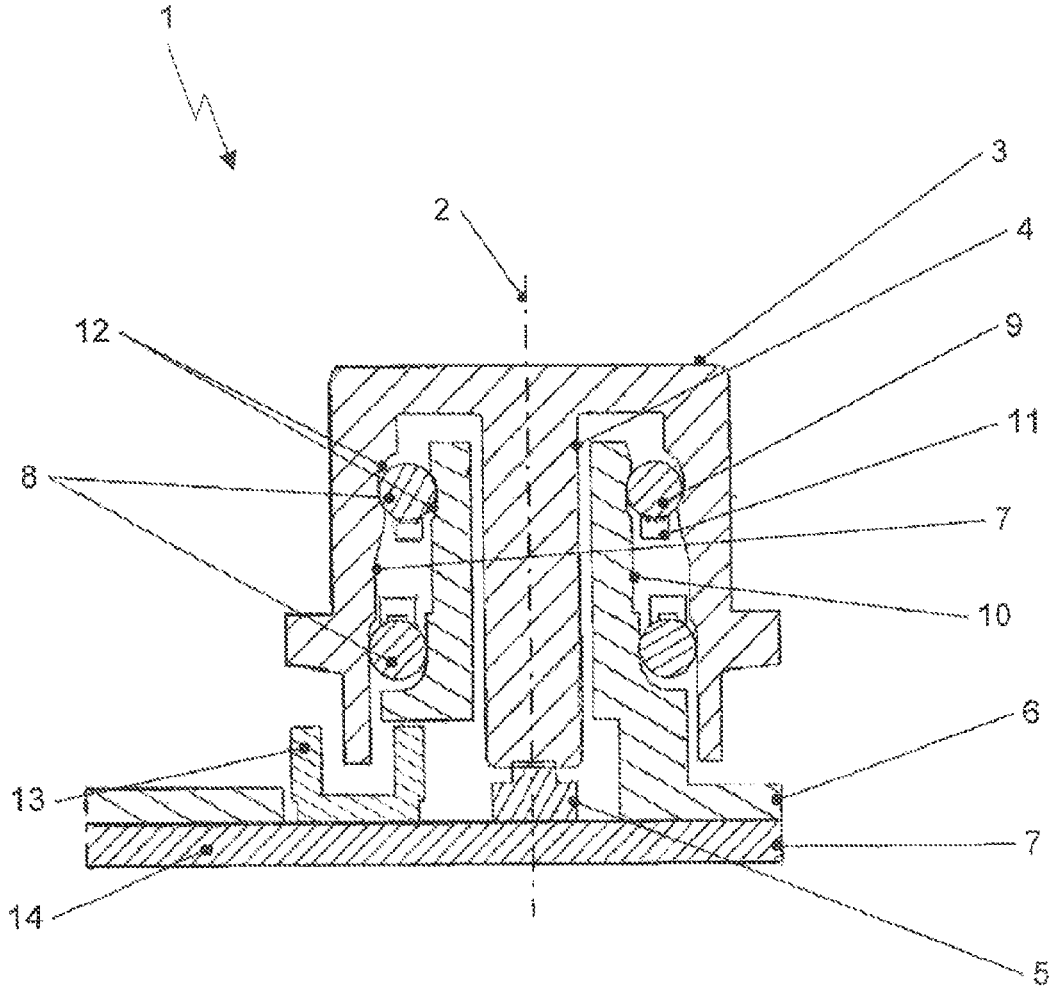
FIG. 1 schematically shows a sectional view of a rotary/push button controller according to the present invention.

A rotary/push button controller is provided herein. The controller includes an outer ring being movable, radially at a rotation angle about a rotation axis, and axially along the rotation axis, the outer rings being integrally formed with a centrally disposed shaft, the shaft includes a connection to an electric switch in response to the axial movement of the shaft; an intermediate space between an inner wall of the outer ring and the shaft; an inner ring being disposed in the intermediate space between the inner wall of the outer ring and the shaft coaxially in relation to the shaft and to the outer ring; and a roller bearing having at least two rows of roller bodies, which are situated between the inner wall of the outer ring and the outer wall of the inner ring.

DETAILED DESCRIPTION

According to the aspects described herein, the precision and the haptic properties of a rotary/push button controller while retaining the basic functions is improved. The following techniques are employed;

- rotary controller: register the adjustment of the angle of rotation corresponding to the defined classification and convert to electric signals; and
- push button switch: detect actuation and convert to corresponding electric signals The aspects disclosed herein includes a rotary/push button controller having an outer ring that is movable, both radially at a rotation angle about a rotation axis, as well as axially, i.e., along the rotation axis, and which is integrally formed with a centrally disposed shaft. The shaft may be connected to an electric switch or such a connection may be established as a result of the axial movability of the shaft. Further an intermediate space is formed between an inner wall of the outer ring and the shaft. An inner ring being disposed in the intermediate space between the inner wall of the outer ring and the shaft coaxially in relation to the shaft and to the outer ring. A roller bearing having at least two rows of roller bodies, which are situated between the inner wall of the outer ring and the outer wall of the inner ring, with the inner wall of the outer ring and the outer wall of the inner ring provide the rolling surface for the roller bodies. The rotation angle movement of the outer ring being registered or detected electronically.

An advantage of the structures above is the absence of wobbling of the rotary button formed by the outer ring. Further, friction is minimized occurring due to the roller bearing and the centrally disposed shaft provided for activating the electric switch. In addition, at least two rows of a roller bearing, preferably a ball bearing, are integrated in the rotary button. Of particular advantage is the integrated push button function, i.e., the shaft for activating the electric switch is integrated in the outer ring, which is movable axially, i.e., corresponding to the movement of the button. The rotary/push button controller is particularly suitable in the case of very small rotary buttons having a diameter, for example, of <20 mm.

Further, a circuit board may be fixed to the inner ring, on which circuit board the electric switch may also be located.

A photoelectric element may be employed for electrical registration of the rotation angle movement of the outer ring. According to aspect, the outer ring exhibits an integrated geometry, in particular, a tooth geometry which makes it possible to electrically register the movement of the rotation angle of the outer ring with the aid of a light-sensitive barrier.

According to an aspect disclosed herein, a locking cam is situated on the periphery of the outer ring. The locking geometry allows for integration with the rotary controller functions to provide haptic feedback. A spring element is provided, which engages in the locking cam. In this case, the haptic properties result from the locking cam and the geometry and characteristics of the spring element.

The radial movement is stopped by an end stop. The outer ring is moveable by 360°.

As previously mentioned, the roller bearing is in the form of at least two rows consisting of ball-shaped roller bodies, wherein the ball-shaped roller bodies of one row are each situated in a cage, which keeps the balls spaced apart from one another. The rotary/push button controller is designed preferably similar to a grooved ball bearing, and includes the three individual components:

1. the outer ring having the centrally disposed shaft,
2. the two rows of roller bearings, wherein each row consists of a cage having preferably ball-shaped roller bodies, and
3. the inner ring.

In addition, snap hooks may be integrated in the rotary/push button controller for fastening decorative parts. The snap hooks may be attached to the periphery of the outer ring. The number, shape and size of the snap hooks may be designed in accordance with the mechanical requirements.

FIG. 1 shows a schematic section through a rotary/push button controller 1 or rotary/push button 1 according to aspects disclosed herein. Rotary/push button 1 includes an outer ring 3 movable about a rotational axis 2, and a shaft 4 disposed centrally inside the outer ring 3 for activating a push button 5 or an electric switch 5. In this case, the shaft 4 is integrated into the component of the outer ring 3, i.e., the shaft 4 and the outer ring 3 form a single structural component. In addition, the rotary/push button 1 comprises an inner ring 6, which is disposed within the outer ring 3 coaxially to the latter, and at the same time encircles the shaft 4. Thus, the inner ring 6 is situated in an intermediate space between the shaft 4 and an inner wall 7 of the outer ring 3. Integrated in the rotary button 1 are two rows of a roller bearing 8, which include roller bodies 9, which are situated in the intermediate space between the inner wall 7 of the outer ring 3 and the outer wall 10 of the inner ring 6. In this design, the roller bodies 9 of one row are each held spaced equally apart by a cage 11. In this exemplary embodiment, this involves, as shown in FIG. 1, a roller bearing 8, in which balls serve as roller bodies 9, also referred to colloquially as ball bearings 8. The rotary/push button 1 is similar in design to a grooved ball bearing. As shown in FIG. 1, at least partially arcuate recesses 12 are provided in both the outer wall 10 of the inner ring 6 and in the inner wall 7 of the outer ring 3 in the area of the guide surfaces or rolling surfaces for the roller bodies 9, or balls 9.

The outer ring 3 is movable or displaceable, both radially, i.e., about a rotation angle of 360°, and axially, i.e., corresponding to the movement of the button in the direction of the axis of rotation 2. The rotation angle movement is registered electrically with the aid of a photoelectric element 13. A circuit board 14 is fixed to the inner ring 6, according to FIG. 1, on the underside of the inner ring 6. The centrally disposed shaft 4 establishes the connection to an electric switch 5 or a press button 5, which is also situated on the circuit board 14.

In addition, a locking cam is disposed on the periphery of the outer ring 3. The haptic properties result from the locking cam and the geometry. A spring element engages in the locking cam, which engages in the locking cam, aiding to the haptics.

Figure 2:
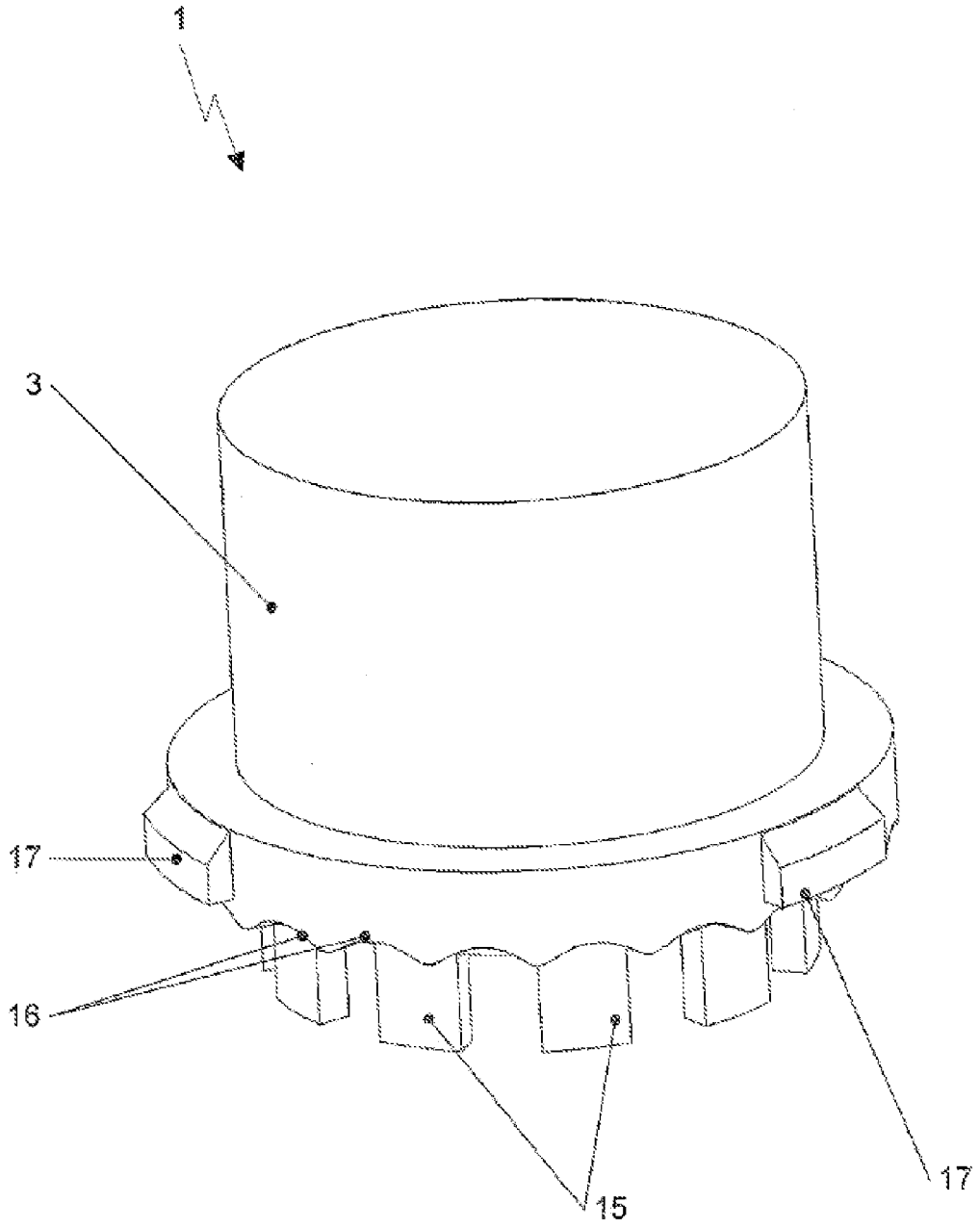
FIG. 2 shows a perspective view of the outer ring of the rotary/push button controller.

FIG. 2 shows a perspective, spatial view of the outer ring 3 of the rotary/push button controller 1. The outer ring 3 in this view exhibits an integrated geometry, which makes it possible to register electrically the rotation angle movement of the outer ring 3 with the aid of a light-sensitive barrier. In the example shown in FIG. 2, this geometry is a tooth geometry made up of tooth elements 15, which are disposed at regular intervals over the entire periphery of the underside of the outer ring 3.

According to the embodiment of the invention shown in FIG. 2, a locking cam 16 is disposed on the periphery of the outer ring. The locking geometry integrated in the rotary controller 1 provides haptic feedback. A spring element not depicted in FIG. 2 is preferably provided, which engages in the locking cam.

In addition, snap hooks 17 are integrated in the rotary/push button controller 1 for fastening decorative parts, wherein the snap hooks 17 are attached to the periphery of the outer ring. The connection is made by clipping the components together with the snap hooks 17. Number, shape and size of the snap hooks 17 may be designed in accordance with the mechanical requirements.

I claim:

1. A rotary/push button controller, comprising:

an outer ring being movable, radially at a rotation angle about a rotation axis, and axially along the rotation axis, the outer rings being integrally formed with a centrally disposed shaft, the shaft includes a connection to an electric switch in response to the axial movement of the shaft;

an intermediate space between an inner wall of the outer ring and the shaft;

an inner ring being disposed in the intermediate space between the inner wall of the outer ring and the shaft coaxially in relation to the shaft and to the outer ring;

a roller bearing having at least two rows of roller bodies, which are situated between the inner wall of the outer ring and the outer wall of the inner ring, a photoelectric element to electrically register a rotation of the outer ring;

wherein the outer ring includes an integrated geometry with a plurality of light-sensitive sensors, the plurality of light sensors being configured to interact with the photoelectric element, the plurality of light-sensitive sensors each being defined by one of a plurality of teeth that extend in a direction parallel to the rotation axis, and the plurality of teeth having a plurality gaps in between each two of the plurality of teeth, the photoelectric element is u-shaped, with vertical walls of the photo-electric element defining an opening, and the plurality of teeth being rotated between the opening.

2. The rotary/push button controller according to claim 1, wherein the outer ring includes an integrated geometry with a plurality of light-sensitive sensor.

3. The rotary/push button controller according to claim 1, further comprising a locking cam disposed on a periphery of the outer ring.

4. The rotary/push button controller according to claim 3, further comprising a spring element to engage the locking cam.

5. The rotary/push button controller of claim 4, wherein the spring element is configured to provide haptic feedback in accordance with an operation of the rotary/push button controller.

6. The rotary/push button controller according to claim 1 wherein the roller bearing is at least two rows of roller bodies, each in a cage.

7. The rotary/push button controller of claim 1, wherein the inner ring is attached to a circuit board, with a hollow portion provided to allow placement of the photo-electric element.

* * * * *